US006334647B1

(12) United States Patent
Khorasi

(10) Patent No.: US 6,334,647 B1
(45) Date of Patent: Jan. 1, 2002

(54) INFANT REGURGITATION MEASURING CHAIR

(76) Inventor: Carolyn L. Khorasi, 274 Winter Ave., Decatur, GA (US) 30030

( * ) Notice: Subject to any disclaimer, the term of this patent is extended or adjusted under 35 U.S.C. 154(b) by 18 days.

(21) Appl. No.: 09/616,928

(22) Filed: Jul. 14, 2000

(51) Int. Cl.[7] ..... A47B 83/02
(52) U.S. Cl. ..... 297/148
(58) Field of Search ..... 297/148, 182, 297/188.2, 488; 73/426, 427, 428, 429

(56) References Cited

U.S. PATENT DOCUMENTS 2,168,513 A * 8/1939 Cobb ..... 297/153
3,146,738 A * 9/1964 Telarico ..... 297/153
4,359,045 A 11/1982 Cozzi
4,471,767 A 9/1984 Guimond
4,606,576 A * 8/1986 Jones ..... 297/153
4,610,039 A 9/1986 Stern
5,082,220 A 1/1992 Pollock et al.
D365,936 S 1/1996 Haut et al.
5,586,800 A * 12/1996 Triplett ..... 297/148
5,806,922 A 9/1998 Mendelovich
6,126,236 A * 10/2000 Wu ..... 297/325

* cited by examiner

*Primary Examiner*—Carl D. Friedman
*Assistant Examiner*—Dennis L. Dorsey

(57) ABSTRACT

An infant regurgitation measuring chair for collecting and measuring the quantity of regurgitation from an infant. The infant regurgitation measuring chair includes a chair, a tray assembly removably coupled to the chair, and a collection container adapted for receiving the regurgitation of an infant.

19 Claims, 2 Drawing Sheets

INFANT REGURGITATION MEASURING CHAIR

BACKGROUND OF THE INVENTION

1. Field of the Invention

The present invention relates to chairs for infants and more particularly pertains to a new infant regurgitation measuring chair for collecting and measuring the quantity of regurgitation from an infant.

2. Description of the Prior Art

The use of chairs for infants is known in the prior art. More specifically, chairs for infants heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,359,045; U.S. Pat. No. 4,610,039; U.S. Pat. No. 4,471,767; U.S. Pat. No. 5,082,220; U.S. Pat. No. 5,806,922; and U.S. Pat. No. 365,936.

While these devices fulfill their respective, particular objectives and requirements, the aforementioned patents do not disclose a new infant regurgitation measuring chair. The inventive device includes a chair, a tray assembly removably coupled to the chair, and a collection container adapted for receiving the regurgitation of an infant.

In these respects, the infant regurgitation measuring chair according to the present invention substantially departs from the conventional concepts and designs of the prior art, and in so doing provides an apparatus primarily developed for the purpose of collecting and measuring the quantity of regurgitation from an infant.

SUMMARY OF THE INVENTION

In view of the foregoing disadvantages inherent in the known types of chairs for infants now present in the prior art, the present invention provides a new infant regurgitation measuring chair construction wherein the same can be utilized for collecting and measuring the quantity of regurgitation from an infant.

The general purpose of the present invention, which will be described subsequently in greater detail, is to provide a new infant regurgitation measuring chair apparatus and method which has many of the advantages of the chairs for infants mentioned heretofore and many novel features that result in a new infant regurgitation measuring chair which is not anticipated, rendered obvious, suggested, or even implied by any of the prior art chairs for infants, either alone or in any combination thereof.

To attain this, the present invention generally comprises a chair, a tray assembly removably coupled to the chair, and a collection container adapted for receiving the regurgitation of an infant.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new infant regurgitation measuring chair apparatus and method which has many of the advantages of the chairs for infants mentioned heretofore and many novel features that result in a new infant regurgitation measuring chair which is not anticipated, rendered obvious, suggested, or even implied by any of the prior art chairs for infants, either alone or in any combination thereof.

It is another object of the present invention to provide a new infant regurgitation measuring chair which may be easily and efficiently manufactured and marketed.

It is a further object of the present invention to provide a new infant regurgitation measuring chair which is of a durable and reliable construction.

An even further object of the present invention is to provide a new infant regurgitation measuring chair which is susceptible of a low cost of manufacture with regard to both materials and labor, and which accordingly is then susceptible of low prices of sale to the consuming public, thereby making such infant regurgitation measuring chair economically available to the buying public.

Still yet another object of the present invention is to provide a new infant regurgitation measuring chair which provides in the apparatuses and methods of the prior art some of the advantages thereof, while simultaneously overcoming some of the disadvantages normally associated therewith.

Still another object of the present invention is to provide a new infant regurgitation measuring chair for collecting and measuring the quantity of regurgitation from an infant.

Yet another object of the present invention is to provide a new infant regurgitation measuring chair which includes a chair, a tray assembly removably coupled to the chair, and a collection container adapted for receiving the regurgitation of an infant.

Still yet another object of the present invention is to provide a new infant regurgitation measuring chair that provides support for an infant while seated, while the infant's head is reclined, and during regurgitation.

Even still another object of the present invention is to provide a new infant regurgitation measuring chair that can be quickly disassembled and cleaned.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
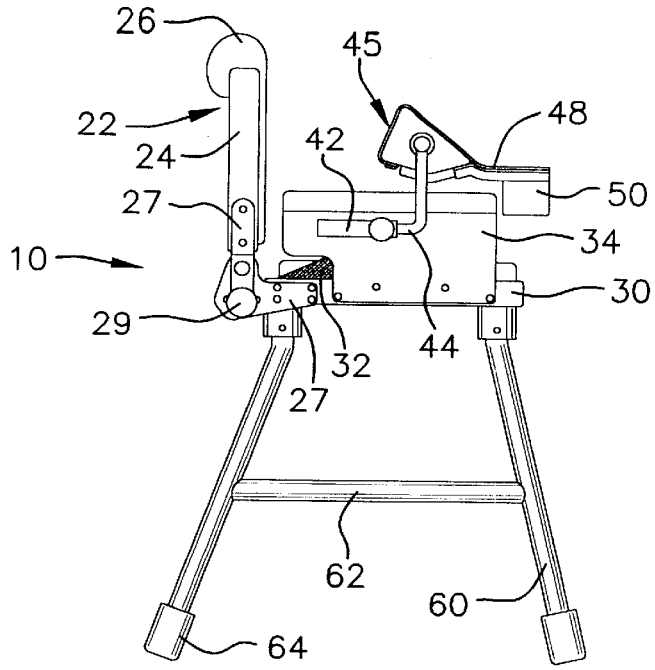
FIG. 1 is a schematic side view of a new infant regurgitation measuring chair according to the present invention.
Figure 2:
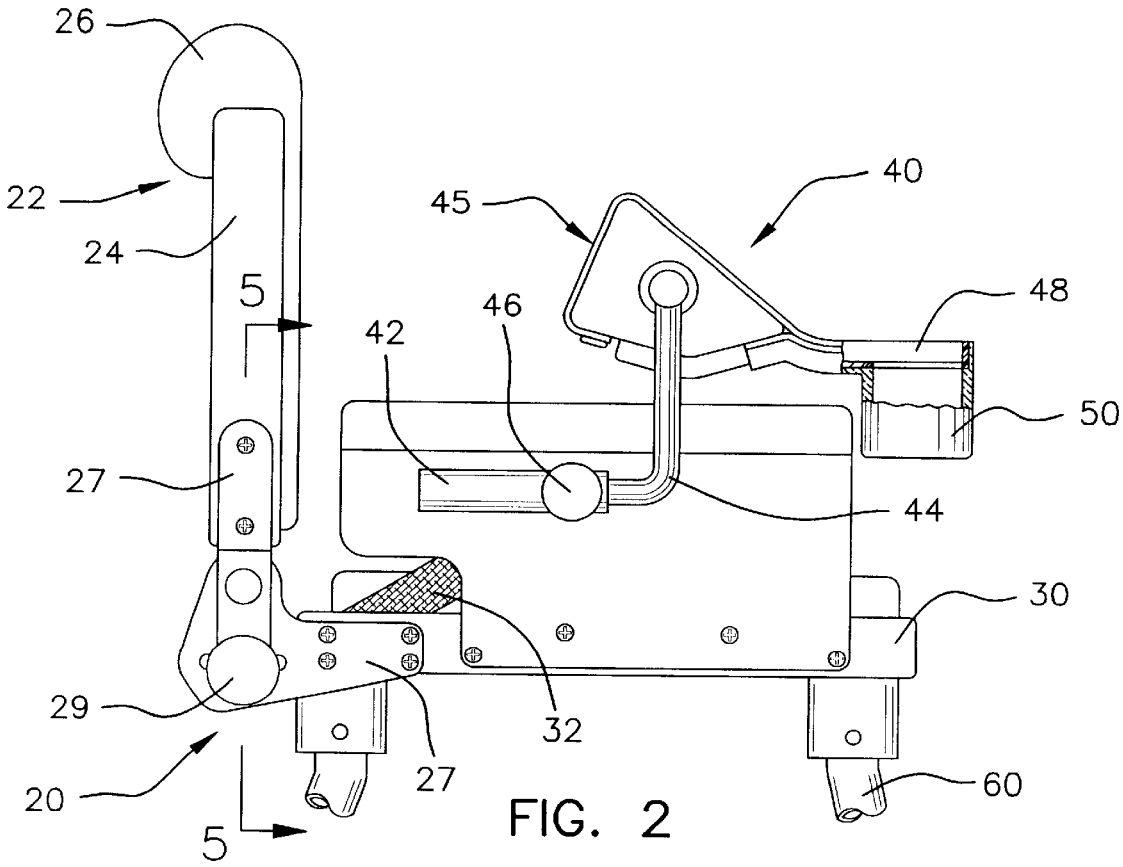
FIG. 2 is a schematic detail view of the present invention.
Figure 3:
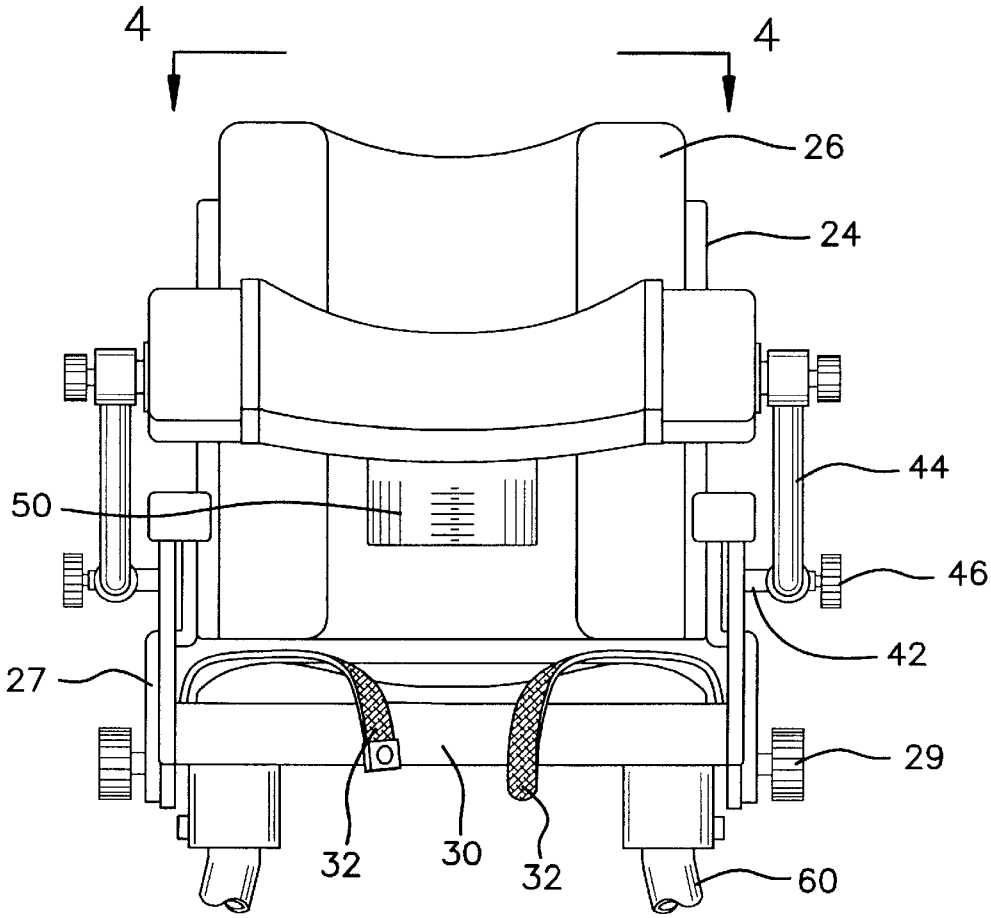
FIG. 3 is a schematic front view of the present invention.
Figure 4:
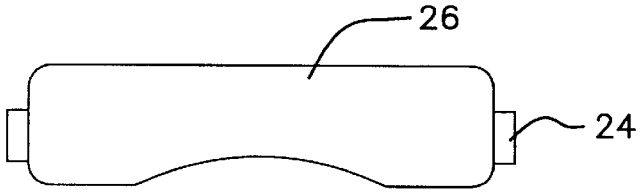
FIG. 4 is a schematic cross-sectional view of the present invention taken along line 4—4 of FIG. 3.
Figure 5:
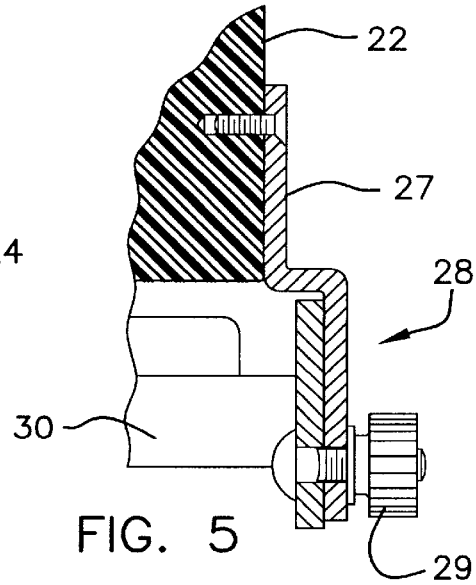
FIG. 5 is a schematic detail view of the back adjustment assembly of the present invention.

With reference now to the drawings, and in particular to FIGS. 1 through 5 thereof, a new infant regurgitation measuring chair embodying the principles and concepts of the present invention and generally designated by the reference numeral 10 will be described.

As best illustrated in FIGS. 1 through 5, the infant regurgitation measuring chair 10 generally comprises a chair 20, a tray assembly 40, and a collection container 50.

The chair 20 includes a back portion 22, a seat portion 30, and a pair of selectively removable leg assemblies.

The back portion 22 includes a backing member 24 and a pad member 26 covering a front face of the backing member 24.

The pad member 26 extends over an upper edge of the backing member 24. Thus an upper portion of the pad member 26 is designed for supporting a head of an infant when the infant's head it tilted back toward the back portion 22.

A front surface of the pad member 26 includes a substantially vertical depression extending between an uppermost edge of the pad member 26 and a lowermost edge of the pad member 26. Thus the depression is designed receiving the back of the infant for holding the infant in an upright orientation while the infant is seated in the chair 20.

In an embodiment each of the leg assemblies includes a pair of legs 60 and a cross member 62 extending between the legs 60.

Each of a plurality of rubber foot pads 64 is coupled to a distal end of an associated one of the legs 60. Thus the legs 60 are designed for preventing slippage of the distal ends of the legs 60 along a supporting surface.

A pair of back adjustment assemblies 28 is coupled between a lower end of the back portion 22 and a rearward end of the seat portion 30. Each the back adjustment assembly 28 includes a pair of pivoting arms 27 for facilitating tilting of the back portion 22 relative to the seat portion 30.

Each of the back adjustment assemblies 28 includes a back adjustment locking member 29 for selectively engaging the pivoting arms 27. Thus the pivoting arms 27 are held in a static position relative to each other.

Each of a pair of strap members 32 includes a proximal end coupled to the seat portion 30 of the chair 20. Each of the strap members 32 includes a distal end. The distal ends of the strap members 32 are couplable to each other. Thus the strap members 32 are designed for securing the infant to the seat portion 30.

A pair of arms 34 is coupled to the seat portion 30 of the chair 20.

Each of a pair of the tray connecting members 42 is coupled to an associated one of the arms 34. Each of the tray connecting members 42 is cylindrical.

A tray assembly 40 is removably couplable to the chair 20. The tray assembly 20 includes a pair of generally L-shaped connection arms 44. Each of the connection arms 44 includes a first flange and a second flange. The first flange is slidably insertable into an associated one of the tray connecting members 42.

Each of the tray connecting members 42 includes a tray assembly locking aperture. Each of a pair of tray assembly locking members 46 is threadedly insertable through the tray assembly locking aperture of an associated one of the tray connecting members 42 for permitting adjustable securement of the tray assembly 40 to the chair 20.

The tray assembly 40 includes a tray 48 with a spillway designed for receiving regurgitation of the infant when the infant is seated in the chair 20.

The tray 48 is pivotally coupled to each of the connecting arms 44 for permitting tilting of the tray 48 relative to the connecting arms 44.

The tray assembly 40 includes a pair of tray locking members 46. Each of the tray locking members 46 is coupled to an associated one of the connecting arms 44 for selectively frictionally engaging the tray 48 for facilitating locking of the tray 48 in a static position relative to the connecting arms 44.

The tray assembly 40 further includes a collection container 50 positioned such that the collection container 50 is designed for receiving the regurgitation. The collection container 50 is transparent for permitting visual inspection of an upper surface level of the regurgitation collected in the collection container 50. The collection container 50 includes a plurality of graduated indicia for permitting measurement of an amount of the regurgitation collected in the collection container 50.

The collection container 50 is selectively removable from the tray assembly 40 for facilitating cleaning of the collection container 50 and disposal of the regurgitation collected in the collection container 50.

The tray assembly 40 includes a bearing surface 45 positioned to face the back portion 22 when the tray assembly 40 is coupled to the chair 20. Thus the bearing surface 45 is designed for supporting a torso of the infant when the infant is regurgitating.

In use, an infant is placed in the infant regurgitation measuring chair. The infant is strapped into the chair using the strap members connected to the seat portion. When the infant regurgitates the regurgitation flows down the tray and into the collection container where the regurgitation can be measured.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A regurgitation measuring chair assembly comprising:

a chair;

a tray assembly removably couplable to said chair, said tray assembly including a spillway adapted for receiving regurgitation of an infant seated in said chair; and said tray assembly further including a collection container positioned such that said collection container is adapted for receiving the regurgitation, said collection container having graduated indicia for measuring an amount of the regurgitation collected in said collection container.

2. The regurgitation measuring chair assembly of claim 1, further comprising:

said chair having a back portion, a seat portion, and a pair of selectively removable leg assemblies;

said back portion having a backing member and a pad member covering a front face of said backing member;

said pad member extending over an upper edge of said backing member whereby an upper portion of said pad member is adapted for supporting a head of an infant when the infant's head it tilted back toward said back portion;

a front surface of said pad member including a substantially vertical depression extending between an uppermost edge of said pad member and a lowermost edge of said pad member whereby said depression is adapted receiving a back of the infant for holding the infant in an upright orientation while the infant is seated in said chair.

3. The regurgitation measuring chair assembly of claim 2, further comprising:

wherein each of said leg assemblies includes a pair of legs and a cross member extending between said legs;

a plurality of rubber foot pads, each of said rubber foot pads being coupled to a distal end of an associated one of said legs whereby said legs are adapted for preventing slippage of said distal ends of said legs along a supporting surface.

4. The regurgitation measuring chair assembly of claim 2, further comprising:

a pair of back adjustment assemblies coupled between a lower end of said back portion and a rearward end of said seat portion, each said back adjustment assembly having a pair of pivoting arms for facilitating tilting of said back portion relative to said seat portion;

each of said back adjustment assemblies including a back adjustment locking member for selectively engaging said pivoting arms whereby said pivoting arms are held in a static position relative to each other.

5. The regurgitation measuring chair assembly of claim 2, further comprising:

a pair of strap members, each of said strap members having a proximal end coupled to said seat portion of said chair, each of said strap members having a distal end, said distal ends of said strap members being couplable to each other whereby said strap members are adapted for securing the infant to said seat portion.

6. The regurgitation measuring chair assembly of claim 2, further comprising:

a pair of arms coupled to said seat portion of said chair;

a pair of tray connecting members, each of said tray connecting members being coupled to an associated one of said arms, each of said tray connecting members being cylindrical.

7. The regurgitation measuring chair assembly of claim 1, further comprising:

said tray assembly including a pair of generally L-shaped connection arms, each of said connection arms having a first flange and a second flange, said first flange being slidably insertable into an associated one of said tray connecting members;

each of said tray connecting members including a tray assembly locking aperture;

a pair of tray assembly locking members, each of said tray assembly locking members being threadedly insertable through said tray assembly locking aperture of an associated one of said tray connecting members for permitting adjustable securement of said tray assembly to said chair.

8. The regurgitation measuring chair assembly of claim 7, further comprising:

said tray assembly including a tray having a spillway adapted for receiving regurgitation of the infant when the infant is seated in said chair.

9. The regurgitation measuring chair assembly of claim 2, further comprising:

wherein each of said leg assemblies includes a pair of legs and a cross member extending between said legs;

a plurality of rubber foot pads, each of said rubber foot pads being coupled to a distal end of an associated one of said legs whereby said legs are adapted for preventing slippage of said distal ends of said legs along a supporting surface;

a pair of back adjustment assemblies coupled between a lower end of said back portion and a rearward end of said seat portion, each said back adjustment assembly having a pair of pivoting arms for facilitating tilting of said back portion relative to said seat portion;

each of said back adjustment assemblies including a back adjustment locking member for selectively engaging said pivoting arms whereby said pivoting arms are held in a static position relative to each other;

a pair of strap members, each of said strap members having a proximal end coupled to said seat portion of said chair, each of said strap members having a distal end, said distal ends of said strap members being couplable to each other whereby said strap members are adapted for securing the infant to said seat portion;

a pair of arms coupled to said seat portion of said chair;

a pair of tray connecting members, each of said tray connecting members being coupled to an associated one of said arms, each of said tray connecting members being cylindrical;

said tray assembly including a pair of generally L-shaped connection arms, each of said connection arms having a first flange and a second flange, said first flange being slidably insertable into an associated one of said tray connecting members;

each of said tray connecting members including a tray assembly locking aperture;

a pair of tray assembly locking members, each of said tray assembly locking members being threadedly insertable through said tray assembly locking aperture of an associated one of said tray connecting members for permitting adjustable securement of said tray assembly to said chair;

said tray assembly including a tray having a spillway adapted for receiving regurgitation of the infant when the infant is seated in said chair.

10. The regurgitation measuring chair assembly of claim 8, further comprising:

said tray being pivotally coupled to each of said connecting arms for permitting tilting of said tray relative to said connecting arms;

a pair of tray locking members, each of said tray locking members being coupled to an associated one of said connecting arms for selectively frictionally engaging said tray for facilitating locking of said tray in a static position relative to said connecting arms.

11. The regurgitation measuring chair assembly of claim 9, further comprising:

said tray being pivotally coupled to each of said connecting arms for permitting tilting of said tray relative to said connecting arms;

a pair of tray locking members, each of said tray locking members being coupled to an associated one of said connecting arms for selectively frictionally engaging said tray for facilitating locking of said tray in a static position relative to said connecting arms.

12. The regurgitation measuring chair assembly of claim 8, further comprising:

said tray assembly further including a collection container positioned such that said collection container is adapted for receiving the regurgitation, said collection container having graduated indicia for measuring an amount of the regurgitation collected in said collection container;

said collection container being transparent for permitting visual inspection of an upper surface level of the regurgitation collected in said collection container, said collection container including a plurality of graduated indicia for permitting measurement of an amount of the regurgitation collected in the collection container.

13. The regurgitation measuring chair assembly of claim 9, further comprising:

said tray assembly further including a collection container positioned such that said collection container is adapted for receiving the regurgitation, said collection container having graduated indicia for measuring an amount of the regurgitation collected in said collection container;

said collection container being transparent for permitting visual inspection of an upper surface level of the regurgitation collected in said collection container, said collection container including a plurality of graduated indicia for permitting measurement of an amount of the regurgitation collected in the collection container.

14. The regurgitation measuring chair assembly of claim 12, further comprising:

said collection container being selectively removable from said tray assembly for facilitating cleaning of said collection container and disposal of the regurgitation collected in said collection container.

15. The regurgitation measuring chair assembly of claim 13, further comprising:

said collection container being selectively removable from said tray assembly for facilitating cleaning of said collection container and disposal of the regurgitation collected in said collection container.

16. The regurgitation measuring chair assembly of claim 1, further comprising:

said tray assembly including a bearing surface positioned to face said back portion when said tray assembly is coupled to said chair whereby said bearing surface is adapted for supporting a torso of the infant when the infant is regurgitating.

17. The regurgitation measuring chair assembly of claim 12, further comprising:

said tray assembly including a bearing surface positioned to face said back portion when said tray assembly is coupled to said chair whereby said bearing surface is adapted for supporting a torso of the infant when the infant is regurgitating.

18. The regurgitation measuring chair assembly of claim 13, further comprising:

said tray assembly including a bearing surface positioned to face said back portion when said tray assembly is coupled to said chair whereby said bearing surface is adapted for supporting a torso of the infant when the infant is regurgitating.

19. A regurgitation measuring chair assembly comprising:

a chair having a back portion, a seat portion, and a pair of selectively removable leg assemblies;

said back portion having a backing member and a pad member covering a front face of said backing member;

said pad member extending over an upper edge of said backing member whereby an upper portion of said pad member is adapted for supporting a head of an infant when the infant's head it tilted back toward said back portion;

a front surface of said pad member including a substantially vertical depression extending between an uppermost edge of said pad member and a lowermost edge of said pad member whereby said depression is adapted receiving a back of the infant for holding the infant in an upright orientation while the infant is seated in said chair;

wherein each of said leg assemblies includes a pair of legs and a cross member extending between said legs;

a plurality of rubber foot pads, each of said rubber foot pads being coupled to a distal end of an associated one of said legs whereby said legs are adapted for preventing slippage of said distal ends of said legs along a supporting surface;

a pair of back adjustment assemblies coupled between a lower end of said back portion and a rearward end of said seat portion, each said back adjustment assembly having a pair of pivoting arms for facilitating tilting of said back portion relative to said seat portion;

each of said back adjustment assemblies including a back adjustment locking member for selectively engaging said pivoting arms whereby said pivoting arms are held in a static position relative to each other;

a pair of strap members, each of said strap members having a proximal end coupled to said seat portion of said chair, each of said strap members having a distal end, said distal ends of said strap members being couplable to each other whereby said strap members are adapted for securing the infant to said seat portion;

a pair of arms coupled to said seat portion of said chair;

a pair of tray connecting members, each of said tray connecting members being coupled to an associated one of said arms, each of said tray connecting members being cylindrical;

a tray assembly removably couplable to said chair;

said tray assembly including a pair of generally L-shaped connection arms, each of said connection arms having a first flange and a second flange, said first flange being slidably insertable into an associated one of said tray connecting members;

each of said tray connecting members including a tray assembly locking aperture;

a pair of tray assembly locking members, each of said tray assembly locking members being threadedly insertable through said tray assembly locking aperture of an associated one of said tray connecting members for permitting adjustable securement of said tray assembly to said chair;

said tray assembly including a tray having a spillway adapted for receiving regurgitation of the infant when the infant is seated in said chair;

said tray being pivotally coupled to each of said connecting arms for permitting tilting of said tray relative to said connecting arms;

a pair of tray locking members, each of said tray locking members being coupled to an associated one of said connecting arms for selectively frictionally engaging said tray for facilitating locking of said tray in a static position relative to said connecting arms;

said tray assembly further including a collection container positioned such that said collection container is adapted for receiving the regurgitation, said collection container having graduated indicia for measuring an amount of the regurgitation collected in said collection container;

said collection container being transparent for permitting visual inspection of an upper surface level of the regurgitation collected in said collection container, said collection container including a plurality of graduated indicia for permitting measurement of an amount of the regurgitation collected in the collection container;

said collection container being selectively removable from said tray assembly for facilitating cleaning of said collection container and disposal of the regurgitation collected in said collection container; and said tray assembly including a bearing surface positioned to face said back portion when said tray assembly is coupled to said chair whereby said bearing surface is adapted for supporting a torso of the infant when the infant is regurgitating.

* * * * *